US007131278B2

(12) United States Patent
Svensson et al.

(10) Patent No.: US 7,131,278 B2
(45) Date of Patent: Nov. 7, 2006

(54) TANK COOLING SYSTEM AND METHOD FOR CRYOGENIC LIQUIDS

(75) Inventors: Orvar Svensson, Taeby (SE); Nils Yngve Appelquist, Koeping (SE); Kenneth Stig Lindqvist, Skarpnaeck (SE); Hans Gustav Sahlen, Vaellingby (SE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/961,370

(22) Filed: Oct. 12, 2004

(65) Prior Publication Data

US 2005/0132719 A1 Jun. 23, 2005

Related U.S. Application Data

(63) Continuation of application No. PCT/EP03/03556, filed on Apr. 4, 2003.

(30) Foreign Application Priority Data

Apr. 10, 2002 (EP) ..... 02008039

(51) Int. Cl.
*F17C 7/02* (2006.01)

(52) U.S. Cl. ..... 62/50.1

(58) Field of Classification Search ..... 62/47.1, 62/48.1, 48.2, 50.1, 376, 602, 238, 238.3
See application file for complete search history.

(56) References Cited

U.S. PATENT DOCUMENTS

| | | | | |
|---|---|---|---|---|
| 3,633,372 | A * | 1/1972 | Kimmel et al. | 62/49.2 |
| 4,211,085 | A * | 7/1980 | Tyree, Jr. | 62/54.1 |
| 4,224,801 | A * | 9/1980 | Tyree, Jr. | 62/54.1 |
| 4,695,302 | A * | 9/1987 | Tyree, Jr. | 62/603 |
| 4,886,534 | A * | 12/1989 | Castan | 62/603 |
| 5,177,974 | A * | 1/1993 | Uren et al. | 62/47.1 |
| 5,924,291 | A * | 7/1999 | Weiler et al. | 62/50.2 |
| 5,934,095 | A * | 8/1999 | Tyree, Jr. | 62/239 |
| 6,044,647 | A * | 4/2000 | Drube et al. | 62/50.1 |
| 6,244,053 | B1 * | 6/2001 | Gulati et al. | 62/50.1 |
| 6,354,088 | B1 * | 3/2002 | Emmer et al. | 62/50.1 |
| 6,367,264 | B1 | 4/2002 | Tyree, Jr. | |
| 6,581,390 | B1 * | 6/2003 | Emmer et al. | 62/50.6 |
| 6,644,039 | B1 * | 11/2003 | Hughes et al. | 62/49.1 |

FOREIGN PATENT DOCUMENTS

DE 19704362 C1 * 1/1998

* cited by examiner

*Primary Examiner*—Mohammad M. Ali
(74) *Attorney, Agent, or Firm*—Crowell & Moring LLP

(57) ABSTRACT

A system and method to transfer a cryogenic liquid from a station tank system to a recipient tank is provided. At least a part of said cryogenic liquid is stored at a first pressure higher than the pressure in said recipient tank and is cooled to a temperature below the equilibrium temperature for said first pressure. The cooled part of said cryogenic liquid is transferred to said recipient tank.

36 Claims, 3 Drawing Sheets

TANK COOLING SYSTEM AND METHOD FOR CRYOGENIC LIQUIDS

BACKGROUND AND SUMMARY OF THE INVENTION

This application is a Continuation of PCT Application No. PCT/EP03/03556 filed Apr. 4, 2003 which claims priority to European Application No. 02008039.6 filed Apr. 10, 2002.

BACKGROUND AND SUMMARY OF THE INVENTION

The invention relates to a system and method to transfer a cryogenic liquid from a station tank system to a recipient tank, wherein at least a part of said cryogenic liquid within said station tank system is stored at a first pressure higher than the pressure in said recipient tank.

Normally bulk liquid $CO_2$ is distributed from various bulk storage tanks, located for example at the place of gas production, —to station tank systems at the customers. The pressure in the bulk distribution chain for liquid $CO_2$, including bulk storage tanks, bulk transport tanks as trailers etc., is normally about 14 to 20 bar. The transport tank takes liquid from the bulk storage tank and delivers it to the station tank system, which means that the pressure in the station tank system will be close to or equal to the pressure in the transport tank.

Applications as for example cooling systems in food transports on trucks often use $CO_2$ as the cooling medium. The $CO_2$ recipient tanks mounted on the trucks, for such cooling systems, normally have an operation pressure of about 8 to 9 bar and with a corresponding equilibrium temperature of about −46° C. With a higher operation pressure in the recipient tank the tank would be heavier and more costly. Further, due to the reduced liquid density and less heat capacity per kg for $CO_2$ at higher temperature and pressure, the cooling capacity per tank volume would be reduced and a larger tank must be used for the same capacity.

Since the recipient tanks are filled with liquid $CO_2$ stored in the large station tank systems, it is then necessary to either reduce the pressure in the station tank or to reduce the pressure of the liquid $CO_2$ when it is transferred from the station tank to the recipient tank. Presently the pressure is reduced before the inlet to the recipient tank by a pressure regulator. In the regulator the liquid $CO_2$ expands and forms a mixture of gaseous and liquid $CO_2$. Both gaseous and liquid $CO_2$ are transferred to the recipient tank. The gaseous $CO_2$ is vented to the atmosphere after passing a vent regulator at the vent outlet system of the recipient tank. This prior art method has the drawbacks that, on the one hand, the filling will take longer since a two-phase-fluid flows into the recipient tank and that, on the other hand, the gas losses are high. It is also not easy to measure the amount of liquid gas, which has been filled into and stays in the recipient tank.

Therefore it is an object of the present invention to provide a method to increase the filling speed and to reduce the gas losses at the transfer of a cryogenic liquid from a station tank to a recipient tank.

This object has been fulfilled by a method to transfer a cryogenic liquid from a station tank system to a recipient tank, wherein at least a part of said cryogenic liquid within said station tank system is stored at a first pressure higher than the pressure in said recipient tank which is characterized in that at least a part of said cryogenic liquid within said station tank system is cooled to a temperature below the equilibrium temperature for said first pressure and that said cooled part of said cryogenic liquid is transferred to said recipient tank.

The station tank system comprises one or more station tanks which are used to store the cryogenic liquid prior to delivering it to a recipient tank.

The expression "cryogenic liquid" shall in particular include liquid carbon dioxide. The main idea of the invention is to provide a system where a part of the stored cryogenic liquid is kept at a temperature near the temperature in the recipient tank. If no pump is used to transfer the liquid gas from the station tank to the recipient tank at least a part of the cryogenic liquid is preferably stored at a higher pressure than the recipient tank pressure. If a pump is used to transfer the liquid gas from the station tank to the recipient tank it is advantageous to store the cryogenic liquid at essentially the same pressure as in the recipient tank. In the later alternative the station tank system might comprise two tanks. The main advantage of the invention is that the gas losses, normally generated as a result of the decrease in temperature, i.e. decrease in pressure, can be reduced or completely eliminated.

Preferably the temperature of said cooled part of said cryogenic liquid differs from the temperature in said recipient tank as little as possible, preferably by no more than 5 K (5° C.).

According to a preferred embodiment the station tank system comprises a first and a second tank. Normally, the pressure in the first tank essentially exceeds the pressure in the recipient tank or the desired pressure in the recipient tank. A part of the cryogenic liquid is transferred from said first tank to the second tank where said cryogenic liquid is cooled down and kept at lower equilibrium pressure.

When the recipient tank shall be filled, the pressure in the second tank is increased by feeding gas from the first tank to the second tank. Then liquid cryogen is pushed by the pressure difference between the second tank and the recipient tank into the recipient tank. The liquid cryogen could also be delivered by a pump from the second tank to the recipient tank. The pressure in the second tank is then preferably equal to or just above the pressure in the recipient tank.

When liquid is transferred from the first tank to the second tank it is advantageous to return gas, resulting from the evaporation of cryogenic liquid in the second tank, back to the station first tank. Since the pressure in the second tank is normally lower than the pressure in the first tank, it is necessary to use a compressor to transfer the gas back to the first tank. The gas leaving the compressor is preferably cooled in a heat exchanger with the same gas before it enters the compressor. Thus the heat transferred to the first tank is minimized.

However, as a consequence of the heat created by the compressor when pumping gas back to the first tank, the pressure in the first tank will increase. In this case it is therefore advantageous to start a cooling machine to cool the gas phase in said first tank and to lower the pressure in the first tank to the desired value.

Preferably the temperature of the liquid gas in said second tank exceeds the temperature in said recipient tank by no more than 5° C., preferably the temperature of the liquid shall be equal to the normal operation temperature in the recipient tank. When it is necessary to refill the second tank with liquid from the first tank it is preferred to use, at the same time, a compressor to pump back gas from the second tank to the first tank. However, the time needed for filling the second tank is then limited by the compressor capacity. If a faster filling is necessary it is also possible to vent some gas from the second tank.

In some cases it might be advantageous to use a cooling machine to cool down and reliquify evaporated gas in the top space of the second tank, instead of using a compressor to return gas to the station tank and hence to lower the pressure in the second tank. However, for cost reasons the compressor solution is normally preferred. An important option to the described two tank solution is to use a pump. instead of a pressure difference to fill the recipient tank. The second tank can be kept at a stable low pressure and low temperature. Gas is only transferred from the first tank to the second tank in order to compensate for depressurization when larger amounts of liquid have been transferred from the second tank into the recipient tank.

An alternative to the two-tank-solution, i.e. the solution of using a second tank for storing a part of the liquid at an extra low temperature, is to create a strong stratification of the liquid in the station tank. In this case only one station tank for storing the cryogenic liquid is necessary. Of course it is also possible to use a station tank system with more than one station tank and to create one or more of these station tanks with the inventive stratification.

Liquid in the lower part of the station tank is subcooled, preferably by indirect heat exchange with a colder fluid, whereas the liquid in the upper parts of the station tank is in equilibrium with the pressure in the head space of the station tank. For example it is possible to subcool liquid $CO_2$ stored in such a station tank by liquid nitrogen.

More preferred is a system where a cooling coil is placed in the lower part of the station tank and the cooling coil is cooled by expanding liquid from the station tank itself. The gas created by expansion and heated by the coil can then be pumped back to the top of the station tank again. The pressure in the station tank, i.e. the gas phase, will be in equilibrium with the surface temperature of the cryogenic liquid, whereas the bottom temperature in the station tank will be as low as can be achieved with help of the stratification. The degree of stratification is dependent on the geometry and insulation of the tank. This results in that the temperature in the station tank decreases from. the top to the bottom of the tank. In case cryogenic liquid shall be delivered to the recipient tank, only subcooled liquid from the bottom of the tank is fed to the recipient tank.

To avoid ice formation in the cooling coil due to the expansion a backpressure regulator might be placed downstream of the coil. Preferably all of said liquid withdrawn from the station tank is gasified during the expansion. To ensure that all liquid has totally changed into the gaseous state a temperature sensor is preferably placed downstream of the cooling coil and upstream of the pressure regulator. The temperature sensor checks that the temperature is above the equilibrium temperature for the pressure set by the pressure regulator.

The gas resulting from the expansion of cryogenic liquid from the station tank is, after it has been used as a heat exchange medium to cool the liquid in the lower part of the station tank, preferably compressed and returned to the station tank to minimize the gas losses. It is even more preferred to compress the gas to a pressure essentially exceeding the pressure in the station tank, cooling the gas and then cooling expanding the compressed cooled and liquefied gas into the station tank. At the expansion of the liquefied gas it converts into a mixture of cooler liquid and gas which cools and/or reliquefies gas in the headspace of the station tank.

The invention is particularly advantageous in the delivery of liquid $CO_2$ from a station tank system to recipient tanks.

The invention will now be illustrated in greater detail with reference to the appended schematic drawings. It is obvious for the man skilled in the art that the invention may be modified in many ways and that the invention is not limited to the specific embodiments described in the following examples.

DETAILED DESCRIPTION OF THE DRAWINGS

Figure 1:
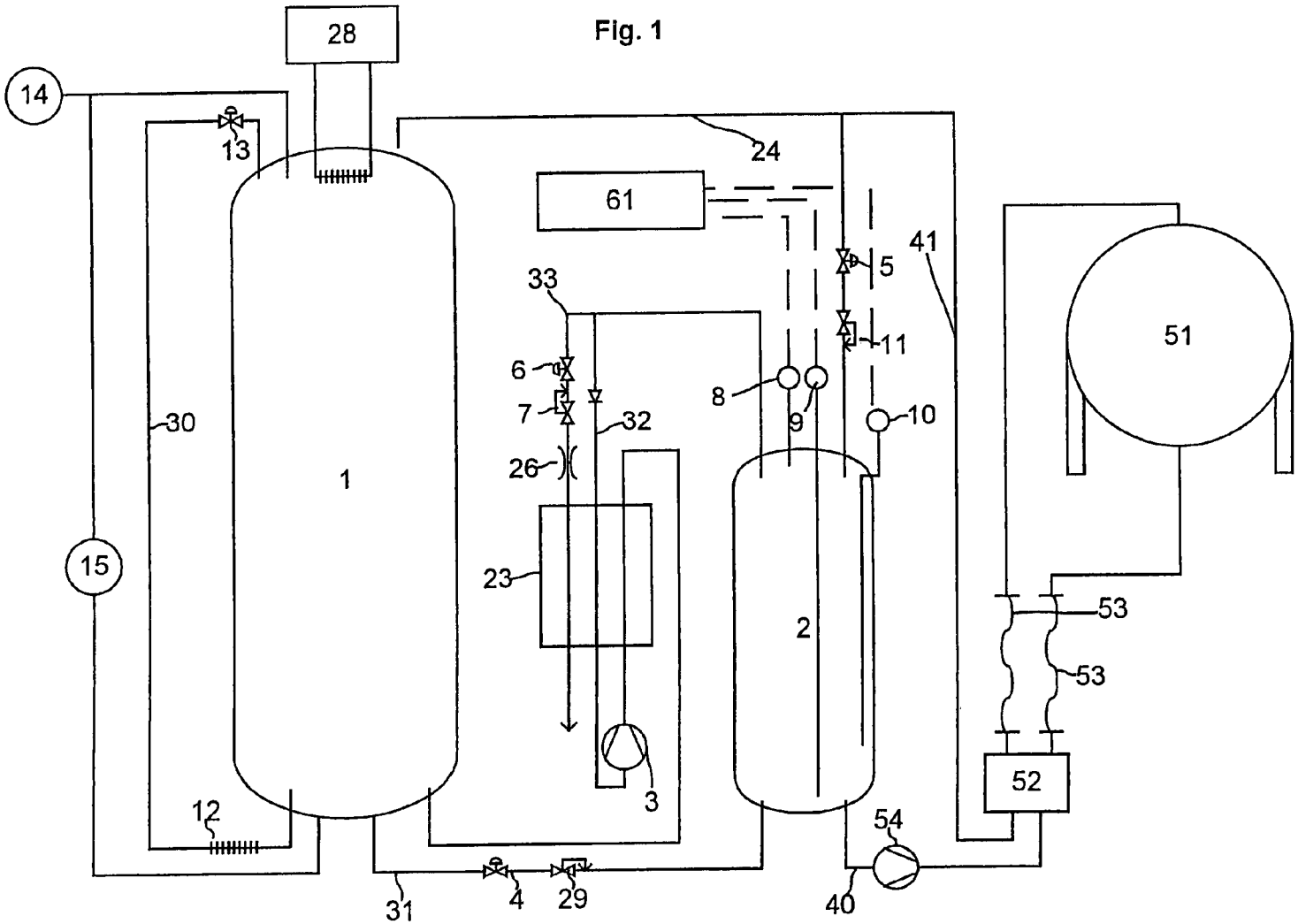
FIG. 1 shows a system according to the invention using a second tank for the extra cooled liquid.

The system according to FIG. 1 is used to transfer liquid carbon dioxide from a station tank system to a recipient tank 51. The system comprises a main station tank 1, a smaller $CO_2$ tank 2 and the recipient tank 51 which is to be filled. Normally the pressure in station tank 1 is set to about 15 bar and the pressure in the recipient tank 51 to about 8 bar.

A pressure build-up line 30 is connected with the bottom and the top of main station tank 1. Pressure build-up line 30 comprises a pressure build-up coil or a heat exchanger 12 and a valve 13. If the pressure in station tank 1 is too low, valve 13 is opened and liquid carbon dioxide will flow through line 30 and is evaporated in heat exchanger 12. Resulting $CO_2$ gas enters the top of main station tank 1 and thus the pressure in tank 1 will increase. As will be recognized by the man skilled in the art, such a pressure build-up system is not necessarily part of the invention but might be advantageous if pressure and temperature are low.

A cooling machine 28 is used to keep the pressure in the station tank 1 below a preset value. A pressure indicator 14 and a liquid level indicator 15 determine the pressure and the liquid level in station tank 1, respectively.

The bottom of station tank 1 and the bottom of $CO_2$ tank 2 are connected by line 31 which comprises a transfer valve 4 and a pressure regulator 29. Station tank 1 and $CO_2$ tank 2 are further connected by return pipe 32. Return pipe 32 comprises a heat exchanger 23, and a compressor 3. Compressor 3 may be used to pump back gaseous $CO_2$ from the small tank 2 to station tank 1. In heat exchanger 23 $CO_2$ leaving compressor 3 is cooled in indirect heat exchange with $CO_2$ gas upstream of compressor 3. The pressure ratio of compressor 3 is preferably about 7.7 bar to 15–23 bar.

A venting line 33 branching from return pipe 32 comprises a venting valve 6 and a pressure regulator 7 to set the back pressure. Downstream of pressure regulator 7 an expansion valve 26 is used to set the venting capacity. By means of heat exchanger 23 vent gas flowing through venting line 33 is also used to cool the gas leaving compressor 3. Thus the transfer of heat to station tank 1, created by compressor 3, is minimized. Preferably, compressor 3 is provided with an internal cooler to additionally lower the heat input into station tank 1.

The top of station tank 1 and the top of $CO_2$ tank 2 are connected by a gas phase pipe 24. Pressurization valve 5 and pressure regulator 11 in gas phase pipe 24 may be used to pressurize tank 2. Branching from gas phase pipe 24 is a filling pipe 41 going to the fill box 52. The fill box 52 is used when filling the recipient tank 51. Liquid filling line 40 which allows withdrawing liquid $CO_2$ from tank 2 is also connected to the fill box 52. Filling line 40 optionally comprises a pump 54. The fill box 52 could be manually operated or automized and includes the necessary valves, pressure gauges/transmitters, regulators etc. for such purpose. The recipient tank 51 is normally connected to the fill box 52 by hoses 53. Tank 2 is further provided with a temperature sensor 9 and a pressure sensor 8.

The function of the inventive system will now be described in detail.

First, recipient tank 51 is connected via hoses 53 to the filling system including the fill box 52 and the accessories, which allow delivery of gaseous carbon dioxide and liquid carbon dioxide. Pressure inside recipient tank 51 is normally about 8 bar. Gaseous $CO_2$ is directly taken from station tank 1 to the fill box 52 and used to purge and pressurise the fill box 52 and the recipient tank 51 when needed.

When liquid $CO_2$ shall be delivered into recipient tank 51, a control system 61 first opens valve 5 to pressurize tank 2 to a pressure set by pressure regulator 11. Prior to the pressurization of tank 2 the pressure in tank 2 will be more or less equal to the pressure set by pressure regulator 29, which is preferably equal to the pressure of the recipient tank 51. The liquid $CO_2$ inside tank 2 is in equilibrium with the gaseous $CO_2$ and therefore the liquid $CO_2$ has the corresponding equilibrium temperature. After pressurization the pressure in tank 2, set by pressure regulator 11, is approximately 2–4 bar above the equilibrum pressure. However, the temperature of the liquid $CO_2$ inside tank 2 will remain almost at the earlier. value, which is the temperature corresponding to the lower pressure set by regulator 29 and the set pressure of compressor 3. Thus the liquid $CO_2$ in tank 2 is temporarily sub-cooled which means that the filling time and gas losses will be reduced when filling the recipient tank 51.

When filling the recipient tank 51 sub-cooled $CO_2$ is pushed out from tank 2 via the filling pipe 40 and the fill box 52 into recipient tank 51. In this embodiment pump 54 is not included in filling line 40. When the desired amount of liquid gas has been transferred to recipient tank 51, the fill box 52 stops the transfer of liquid $CO_2$. A signal indicating that the liquid filling procedure is finished will be sent to control system 61, which then causes pressurization valve 5 to close. The piping system in the fill box and the hoses 53 from the fill box 52 to/from the recipient tank 51, is then blown by gaseous $CO_2$ to get rid of liquid $CO_2$.

By using the inventive system sub-cooled $CO_2$, that is liquid $CO_2$ having a lower temperature than corresponds to the actual pressure, is delivered to the recipient tank 51. Preferably, the temperature of the delivered liquid $CO_2$ is equal or close to the operation temperature inside the recipient tank 51. Gas losses, normally generated as a result to decrease the $CO_2$ temperature, can be reduced or even eliminated.

The amount of liquid left in sub-cooled tank 2 is controlled by control system 61 and liquid level indicator 10. If the liquid level in tank 2 is too low, the control system 61 will start the transfer of liquid $CO_2$ from tank 1 into tank 2 to fill up tank 2 to full level.

This is done by opening transfer valve 4 and at the same time starting compressor 3. Liquid $CO_2$ will now flow from tank 1 into tank 2 through pressure regulator 29. Pressure regulator 29 is set to reduce the pressure to the preset level. between the pressure in tank 1 and the recipient tank pressure. Preferably the pressure is lowered to the equilibrium pressure in recipient tank 51 during normal operation, that is in this case to about 8 bar. When the liquid has reached the preset level in $CO_2$ tank 2, level indicator 10 sends a signal to the control system 61. Transfer valve 4 will then be closed and compressor 3 will be turned off when the right pressure is reached, measured by pressure sensor 8.

If too many deliveries of liquid $CO_2$ from tank 2 have to be carried out, it might be necessary to fill tank 2 faster than it can be done due to the compressor capacity. in this case venting valve 6 can be opened and gaseous $CO_2$ can be vented out of tank 2 via venting line 33.

If it takes too much time before the next recipient tank 51 is filled, the temperature in tank 2 will increase above a preset temperature due to heat leakage. Temperature sensor 9 in tank 2 will recognize the temperature increase and send a signal to control system 61 to start compressor 3 to evaporate some liquid and to lower the temperature again. However, it might then be necessary to transfer more liquid from tank 1 to tank 2. It is also possible to use the pressure sensor 8 instead of the temperature sensor 9 to detect too high temperature and pressure in tank 2. But in that case some process parameters must be taken into consideration.

The refilling of main station tank 1, for example from a $CO_2$ truck, is made in the same way as for any standard $CO_2$ tank.

In an alternative embodiment filling line 40 is provided with a pump 54 to fill the recipient tank 51. Tank 2 could then be kept at a stable low pressure. Gaseous $CO_2$ is only delivered from tank 1 to tank 2 in order to compensate for depressurization when a larger amount of liquid is filled into the recipient tank 51. The advantage of such a system is that tank 2 is always ready to transfer liquid $CO_2$ to a recipient tank 51 and that tank 2 could be filled from tank 1 through valve 4 and regulator 29 even when filling the recipient tank 51.

The cold liquid in tank 2 has a temperature equal or close to the temperature in the recipient tank. If transfer pump 54 is used there is no need to pressurize tank 2. It is only necessary to start the pump 54. In that respect the system comprising pump 54 is advantageous when many customers shall use the system since it is always ready for delivery.

Another option for the system of FIG. 1 is to use a cooling machine instead of compressor 3. In that case gaseous $CO_2$ in tank 2 is not returned to tank 1 but cooled by the cooling machine. However, cooling machines for such low temperature are normally quite costly.

Figure 2:
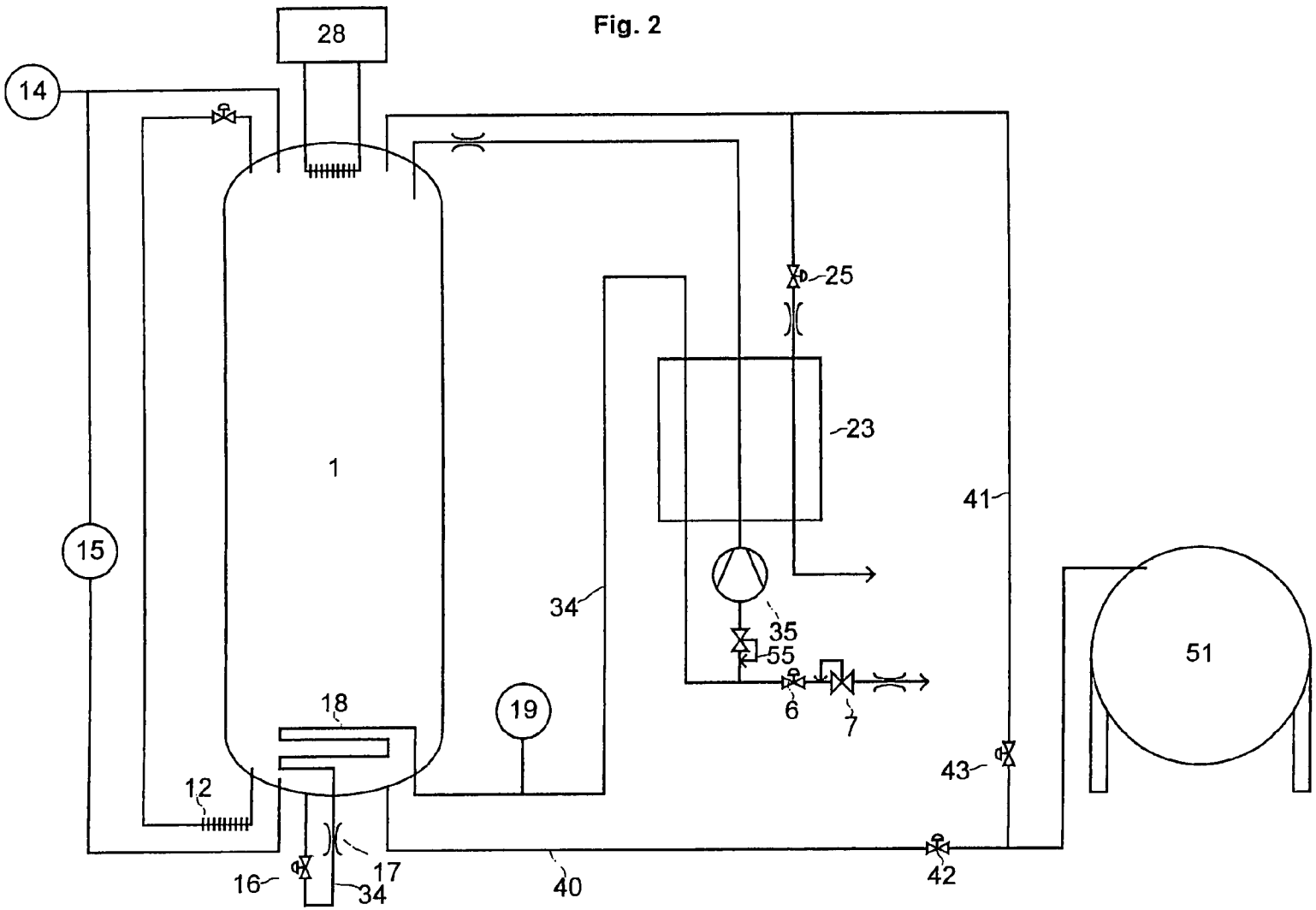
FIG. 2 shows an inventive embodiment with a strong stratification in the station tank.

FIG. 2 shows another embodiment according to the invention. Instead of storing subcooled liquid $CO_2$ in a separate tank 2, a stratification of liquid is created in the main station tank 1.

Part of the liquid $CO_2$ is withdrawn from the bottom of tank 1 and expanded through a nozzle 17 into a heat exchanger coil 18 which is located inside the lower part of tank 1. Downstream of heat exchanger 18 a pressure regulator 55 is provided. Pressure regulator 55 sets a minimum pressure to avoid the formation of dry ice particles in the heat exchanger coil 18 or in pipe 34.

To ensure that all liquid is fully gasified in heat exchanger coil. 18 a temperature sensor 19 is placed between heat exchanger coil 18 and said pressure regulator 55. Temperature sensor 19 checks that the temperature is above the equilibrium temperature for the pressure set by the pressure regulator 55. If the temperature is too low, part of the liquid 002 has not been evaporated in the heat exchanger coil 18. In that case set valve 16 in line 34 reduces the flow of liquid $CO_2$ through heat exchanger coil 18.

Downstream pressure regulator 55 a compressor 35 pumps the gas back into tank 1. The gas leaving the compressor 35 is cooled in heat exchanger 23 prior to entering tank 1. The pressure ratio of compressor 35 is preferably about 5.5 bar to 15 bar.

Heat exchanger coil 18 cools the lower part of the liquid $CO_2$ in tank 1, thus creating a stratification of the liquid. At the liquid surface the temperature of the liquid will be the equilibrium temperature for the pressure inside tank 1, whereas at the bottom of tank 1 in the region near coil 18 the liquid is sub-cooled by heat exchanger coil 18. For example at a pressure of 15 bar in the head space of tank 1 the uppermost stratum of liquid $CO_2$ will have a temperature of about −29° C. and the temperature at the bottom of tank 1 might be less than −40° C.

The sub-cooling process capacity is limited by the capacity of compressor 35. If faster cooling and stratification in tank 1 is necessary, which may be the case soon after tank 1 has been filled, the gas leaving heat exchanger coil 18 can be vented to the atmosphere via valve 6 and pressure regulator 7. Further it is possible to vent gas from the gas phase in tank 1 through heat exchanger 23 to the atmosphere by opening valve 25.

As in the embodiment shown in FIG. 1, heat exchanger 23 is used to minimize the heat transferred to tank 1 by compressor 35. Even the vent gas which flows via valve 6 and regulator 7 to the atmosphere may be used to cool the gas from the compressor 35.

The system according to FIG. 2 has the advantage that only one $CO_2$ tank 1 is necessary. To refill tank 1 it is preferred to feed the liquid $CO_2$ into tank 1 in the top of the tank in order to keep as much as possible of the stratification of the liquid in tank 1.

By installation of a bigger cooling machine 28 and a larger pump 35, as necessary in the system according to FIG. 1, the time could be reduced, when the pressure and the temperature is too high or when the stratification is not sufficient.

Figure 3:
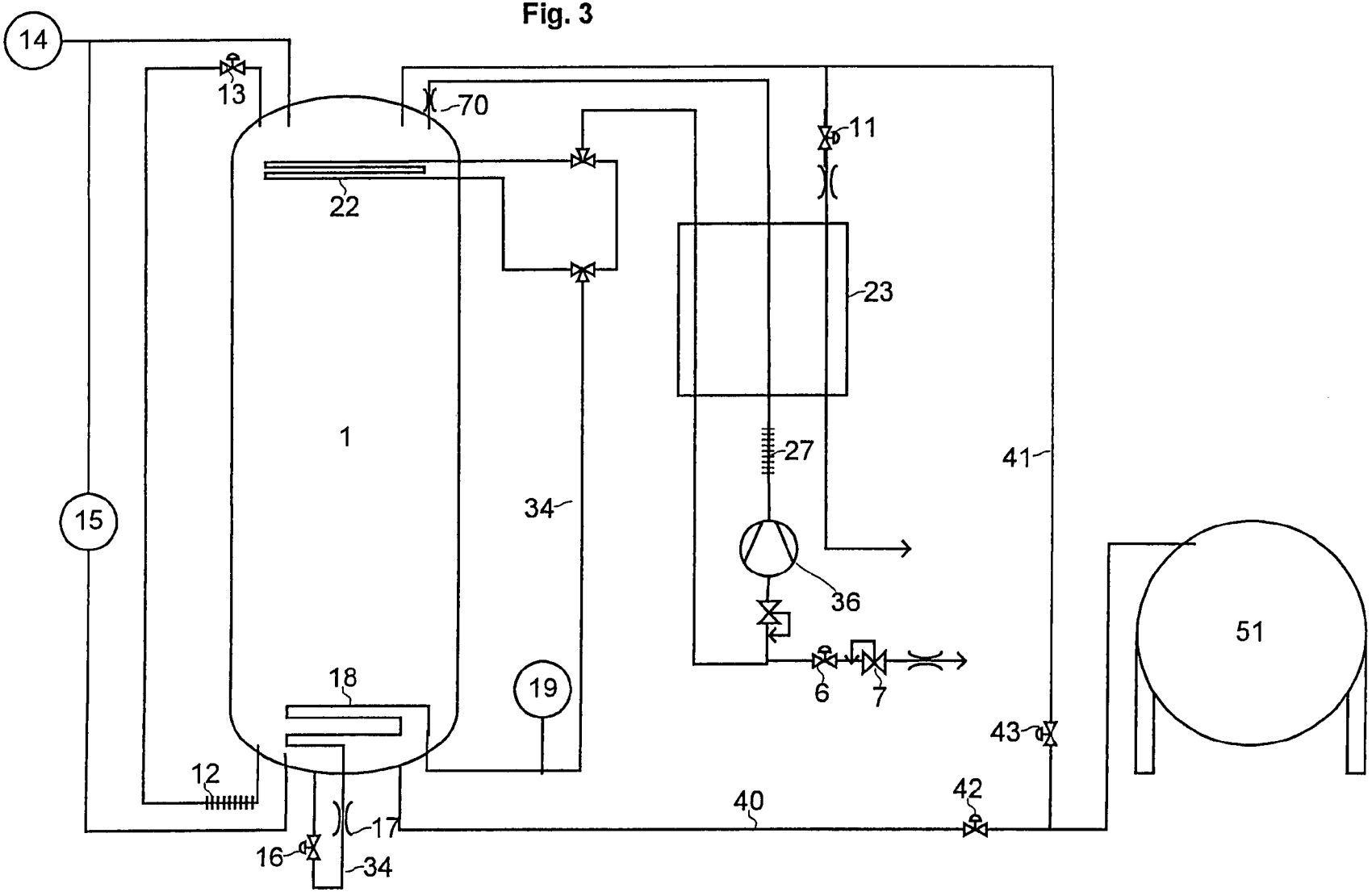
FIG. 3 shows an alternative system with a strong stratification in the station tank.

A further embodiment of the invention is shown in FIG. 3. The system of FIG. 3 also uses a heat exchanger coil 18 to cool the liquid in the lower region of tank 1 and to create stratification. Contrary to the solution of FIG. 2 the gaseous $CO_2$ leaving heat exchanger coil 18 is compressed in compressor 36 to a pressure of at least 50 bar, preferably more than 60 bar, and is partly liquefied. The liquefied $CO_2$ is cooled in the heat exchanger 27 by water or ambient air. After heat exchanger 27 the $CO_2$ is further cooled down in heat exchanger 23 in indirect heat exchange with the very cold gas coming from heat exchanger coil 18 plus, when needed, also from gas direct from the top of the tank 1 by opening valve 11. The liquefied gas expands in nozzle 70, where it converts to a mixture of cooler liquid and gas, and enters tank 1.

The advantage of this solution is that no extra cooling machine except the gas recovery system itself is needed.

In a preferred embodiment liquid gas, which is taken from the bottom of tank 1, is expanded through expansion valve 17 and expanded through coil 18 and then used in a heat exchanger coil 22 to cool the gas phase in tank 1 when needed.

In both embodiments according to FIGS. 2 and 3 the use of a fill box 52 as described with respect to FIG. 1 is advantageous.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method of transferring cryogenic liquid to a recipient tank from a station tank system which includes a first tank and a second tank, said method comprising:

storing at least a part of said cryogenic liquid within said station tank system at a first pressure which is higher than a pressure in said recipient tank, transferring a part of said cryogenic liquid from said first tank to said second tank with cooling thereof to a temperature below an equilibrium temperature for said first pressure to form a cooled part of said cryogenic liquid, and transferring said cooled part of said cryogenic liquid from the second tank to said recipient tank, wherein said second tank is pressurized by feeding gas from the first tank to the second tank to subcool said cryogenic liquid in said second tank and to create a differential pressure necessary for said transferring of said cooled part of said cryogenic liquid to said recipient tank.

2. Method according to claim 1, wherein the temperature of said cooled part of said cryogenic liquid differs from the temperature in said recipient tank by no more than 12° C.

3. Method according to claim 2, wherein the temperature of said cooled part is equal to or a few degrees lower than the temperature of the liquid in the recipient tank.

4. Method according to claim 1, wherein evaporated cryogenic liquid is returned from said second tank to said first tank.

5. Method according to claim 2, wherein evaporated cryogenic liquid is returned from said second tank to said first tank.

6. Method according to claim 1, wherein the pressure in said second tank exceeds the pressure in said recipient tank by no more than 4 bar.

7. Method according to claim 2, wherein the pressure in said second tank exceeds the pressure in said recipient tank by no more than 4 bar.

8. Method according to claim 4, wherein the pressure in said second tank exceeds the pressure in said recipient tank by no more than 4 bar.

9. Method according to claim 1, wherein the pressure in said second tank is equal or close to the pressure of the liquid in said recipient tank and wherein a pump is used to aid transfer of said cryogenic liquid from said second tank to said recipient tank.

10. Method according to claim 1, wherein a cooling machine is provided to cool evaporated cryogenic liquid in said station tank system.

11. Method according to claim 2, wherein a cooling machine is provided to cool evaporated cryogenic liquid in said station tank system.

12. Method according to claim 1, wherein a stratification of cryogenic liquid with different temperatures is created in the station tank system.

13. Method according to claim 1, wherein a part of said liquid cryogenic is withdrawn from said station tank system, expanded and then used to cool a part of said cryogenic liquid within said station tank system.

14. Method according to claim 2, wherein a part of said liquid cryogenic is withdrawn from said station tank system, expanded and then used to cool a part of said cryogenic liquid within said station tank system.

15. Method according to claim 4, wherein a part of said liquid cryogenic is withdrawn from said station tank system, expanded and then used to cool a part of said cryogenic liquid within said station tank system.

16. Method according to claim 6, wherein a part of said liquid cryogenic is withdrawn from said station tank system, expanded and then used to cool a part of said cryogenic liquid within said station tank system.

17. Method according to claim 13, wherein said expanded cryogenic liquid is totally evaporated while cooling said part of said cryogenic liquid within said station tank system.

18. Method according to claim 14, wherein said expanded cryogenic liquid is totally evaporated while cooling said part of said cryogenic liquid within said station tank system.

19. Method according to claim 15, wherein said expanded cryogenic liquid is totally evaporated while cooling said part of said cryogenic liquid within said station tank system.

20. Method according to claim 16, wherein said expanded cryogenic liquid is totally evaporated while cooling said part of said cryogenic liquid within said station tank system.

21. Method according to claim 13, wherein said expanded cryogenic liquid is compressed and returned into said station tank system.

22. Method according to claim 17, wherein said expanded cryogenic liquid is compressed and returned into said station tank system.

23. Method according to claim 21, wherein said expanded cryogenic liquid is compressed to a pressure essentially exceeding said first pressure in said station tank system, preferably to a pressure of at least 50 bar, more preferably to a pressure of at least 60 bar, then cooled and finally expanded into said station tank system.

24. Method according to claim 22, wherein the cryogenic liquid is $CO_2$ which is transferred to said recipient tank.

25. Method according to claim 2, wherein the cryogenic liquid is $CO_2$ which is transferred to said recipient tank.

26. Method according to claim 4, wherein the cryogenic liquid is $CO_2$ which is transferred to said recipient tank.

27. Method according to claim 10, wherein the cryogenic liquid is $CO_2$ which is transferred to said recipient tank.

28. Method according to claim 13, wherein the cryogenic liquid is $CO_2$ which is transferred to said recipient tank.

29. Method according to claim 17, wherein the cryogenic liquid is $CO_2$ which is transferred to said recipient tank.

30. Method according to claim 21, wherein the cryogenic liquid is $CO_2$ which is transferred to said recipient tank.

31. Method according to claim 23, wherein the cryogenic liquid is $CO_2$ which is transferred to said recipient tank.

32. A system for transferring cryogenic liquid to a recipient tank from a station tank system which includes a first tank and a second tank, said system comprising:

a means for storing at least a part of said cryogenic liquid within said station tank system at a first pressure which is higher than a pressure in said recipient tank a means for transferring a part of said cryogenic liquid from said first tank to said second tank with cooling thereof to a temperature below an equilibrium temperature for said first pressure to form a cooled part of said cryogenic liquid, and a means for transferring said cooled part of said cryogenic liquid from the second tank to said recipient tank, wherein said second tank is pressurized by feeding gas from the first tank to the second tank to subcool said cryogenic liquid in said second tank and to create a differential pressure necessary for said transferring of said cooled part of said cryogenic liquid to said recipient tank.

33. A system according to claim 32, wherein the temperature of said cooled part of said cryogenic liquid differs from the temperature in said recipient tank by no more than 12° C.

34. A system according to claim 33, comprising means for returning evaporated cryogenic liquid from said second tank to said first tank.

35. A System according to claim 32, wherein a cooling machine is provided to cool evaporated cryogenic liquid in said station tank system.

36. A system according to claim 32, comprising means for expanding a withdrawal part of said liquid cryogenic from said station tank system and using the expanded part for cooling a part of the cryogenic liquid in the station tank system.

* * * * *